US007995051B2

(12) United States Patent
Huang

(10) Patent No.: US 7,995,051 B2
(45) Date of Patent: Aug. 9, 2011

(54) DRIVING CIRCUIT, DRIVING METHOD AND LIQUID CRYSTAL DISPLAY USING SAME

(75) Inventor: Li-Juan Huang, Shenzhen (CN)

(73) Assignees: Innocom Technology (ShenZhen) Co., Ltd., Shenzhen, Guangong Province (CN); Chimei Innolux Corporation, Miao-Li County (TW)

( * ) Notice: Subject to any disclaimer, the term of this patent is extended or adjusted under 35 U.S.C. 154(b) by 903 days.

(21) Appl. No.: 12/002,365

(22) Filed: Dec. 17, 2007

(65) Prior Publication Data

US 2008/0143703 A1 Jun. 19, 2008

(30) Foreign Application Priority Data

Dec. 15, 2006 (TW) ..... 95147254 A

(51) Int. Cl.
*G09G 5/00* (2006.01)

(52) U.S. Cl. ..... 345/211; 345/87; 345/90; 345/92; 345/98; 345/212; 345/213; 345/214

(58) Field of Classification Search ..... 345/87, 345/90, 92, 98, 211–214
See application file for complete search history.

(56) References Cited

U.S. PATENT DOCUMENTS 5,191,455 A * 3/1993 Hashimoto et al. ..... 345/96
6,424,330 B1 * 7/2002 Johnson ..... 345/96
6,897,908 B2 5/2005 Lee et al.

* cited by examiner

*Primary Examiner* — Richard Hjerpe
*Assistant Examiner* — Saifeldin Elnafia
(74) *Attorney, Agent, or Firm* — Wei Te Chung

(57) ABSTRACT

An exemplary driving circuit includes pixel electrodes (362) applied with voltage signals (VS) respectively via corresponding switching elements (361) connected thereto and common electrodes (363) applied with common voltage signals. Each switching elements includes an input electrode (3613). The driving circuit further includes at least one comparator (40) and a common voltage generator (34). The at least one comparator is configured for obtaining at least one voltage deviation value (ΔV) between the voltage signal of at least one of the pixel electrodes and the voltage signal of the corresponding input electrode. The common voltage generator is configured for generating a common voltage signal according to the at least one voltage deviation value, and outputting to the common voltage signal to the common electrodes.

20 Claims, 3 Drawing Sheets

DRIVING CIRCUIT, DRIVING METHOD AND LIQUID CRYSTAL DISPLAY USING SAME

CROSS-REFERENCE TO RELATED APPLICATION

This application is related to, and claims the benefit of, a foreign priority application filed in Taiwan as Application No. 95147254 on Dec. 15, 2006. The related application is incorporated herein by reference.

FIELD OF THE INVENTION

The present invention relates to a driving circuit of a liquid crystal display (LCD), which includes a correcting circuit for regulating common voltages input to the LCD in order to avoid image flicker.

GENERAL BACKGROUND

LCDs are commonly used as display devices for compact electronic apparatuses, because they not only provide good quality images with little power consumption but also are very thin. A typical LCD includes a liquid crystal panel, a backlight module, and a driving circuit. The backlight module is positioned adjacent to the liquid crystal panel, and is configured to provide uniform light beams to the liquid crystal panel. The driving circuit is configured to drive the liquid crystal panel.

Referring to FIG. 5, a typical driving circuit 2 of an LCD is shown. The driving circuit 2 includes a control circuit 20, a common voltage generator 21, a gate driving circuit 22, a data driving circuit 23, and a pixel control circuit 24. The pixel control circuit 24, the gate driving circuit 22 and the data driving circuit 23 are located on one of two substrates (not shown) of the LCD. The common voltage generator 21 and the control circuit 20 are mounted on a printed circuit board (not shown). The control circuit 20 provides RGB data voltage signals to the data driving circuit 23. The control circuit 20 also provides operation voltage signals, such as gate-on voltage signals and gate-off voltage signals, to the gate driving circuit 22. The data driving circuit 23 and the gate driving circuit 22 respectively transmit the RGB data voltage signals and the operation voltage signals to the pixel control circuit 24 according to a predetermined timing control regime. The common voltage generator 21 is configured to output corresponding standard common voltages to the pixel control circuit 24, when the LCD 2 displays different gray images. The corresponding standard common voltages are written to the common voltage generator 21 by a one-time programmable (OTP) burning process before the LCD 2 is used for the first time.

The pixel control circuit 24 includes a number x (where x is a natural number) of gate lines 241 that are parallel to each other and that each extend along a first direction, and a number y (where y is also a natural number) of data lines 242 that are parallel to each other and that each extend along a second direction orthogonal to the first direction, a plurality of thin film transistors (TFTs) 261 that function as switching elements, a plurality of pixel electrodes 262 and a plurality of common electrodes 263. The plurality of gate lines 241 and the plurality of data lines 242 cross each other, thereby defining a plurality of pixel units (not labeled) of the pixel control circuit 24. Each of the TFTs 261 is provided in the vicinity of a respective point of intersection of the gate lines 241 and the data lines 242, and includes a gate electrode 2611, a source electrode 2613 and a drain electrode 2615. The gate electrode 2611, the source electrode 2613 and the drain electrode 2615 are connected to a corresponding gate line 241, a corresponding data line 242 and a corresponding pixel electrode 262 respectively.

The control circuit 20 transmits corresponding signals to the gate driving circuit 22 and the data driving circuit 23 so that the gate driving circuit 22 and the data driving circuit 23 start working. The gate driving circuit 22 outputs scanning voltage signals Vg to the gate electrodes 2611 of the corresponding TFTs 261 via the gate lines 241 in order to switch on or switch off the TFTs 261. At the same time, the data driving circuit 23 outputs data voltage signals Vs to the source electrodes 2613 of the corresponding TFTs 261 via the corresponding data lines 242. If the TFTs 261 are switched on, the data voltage signals Vs are transmitted to the corresponding pixel electrodes 262 via the data lines 242, source electrodes 2613, and drain electrodes 2615. The common voltage generator 21 outputs the standard common voltage to all the common electrodes 263. Thus, an electric field generated between each activated pixel electrode 262 and the common electrode 263 is applied to liquid crystal molecules (not shown) of the LCD.

Commonly, when the LCD displays a gray scale image using an inversion driving method, potential differences between the pixel electrodes 262 and the common electrodes 263 facing toward the corresponding pixel electrodes 262 in adjacent time frames are required to maintain a constant value. The constant value is equal to an absolute value of a voltage difference between the data voltage signal Vs and the standard common voltage. However, parasitic capacitance may be generated between two electrodes of each TFT 261. In this situation, a voltage signal transmitted to the pixel electrode 262 is interfered with by the parasitic capacitance and deviates from the corresponding data voltage signal Vs. Thus the potential differences in adjacent time frames cannot maintain the constant value, and the resulting images displayed by the LCD are defective. In particular, the images are liable to flicker. Furthermore, the parasitic capacitance can be exacerbated by high ambient temperatures, and when the LCD is continuously used for an extended period of time. In these situations, the flickering of the images may be considerable.

What is needed, therefore, is a driving circuit and a driving method of an LCD that can overcome the above-described deficiencies. What is also needed is an LCD using such a driving circuit.

SUMMARY

In one preferred embodiment, a driving circuit includes a plurality of pixel electrodes arranged in a matrix, a plurality of common electrodes respectively face toward the pixel electrodes, at least one comparator and a common voltage generator. The pixel electrodes are configured for receiving voltage signals via corresponding switching elements connected thereto. Each switching element includes an input electrode. The common electrodes are configured for receiving common voltage signals. The at least one comparator is configured for obtaining at least one voltage deviation value between the voltage signal of at least one of the pixel electrodes and the voltage signal of the corresponding input electrode. The common voltage generator is configured for generating a common voltage signal according to the at least one voltage deviation value, and outputting to the common voltage signal to the common electrodes.

Other novel features and advantages will become more apparent from the following detailed description when taken in conjunction with the accompanying drawings. In the drawings, all the views are schematic.

DETAILED DESCRIPTION OF PREFERRED EMBODIMENTS

Figure 1:
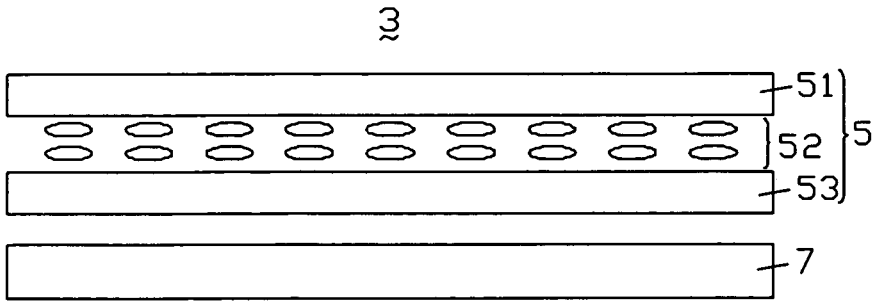
FIG. 1 is a side, cross-sectional view of an LCD according to an exemplary embodiment of the present invention, the LCD including a driving circuit (not shown).

Referring to FIG. 1, an LCD 3 according to an exemplary embodiment of the present invention is shown. The LCD 3 includes a liquid crystal panel 5, and a backlight module 7 adjacent to the liquid crystal panel 5. The backlight module 7 is configured to provide uniform light beams to the liquid crystal panel 5. The liquid crystal panel 5 includes a first substrate 51, a second substrate 53, and a liquid crystal layer 52 sandwiched between the first substrate 51 and the second substrate 53. The LCD 3 further includes a driving circuit (not labeled) for driving the liquid crystal panel 5.

Figure 2:
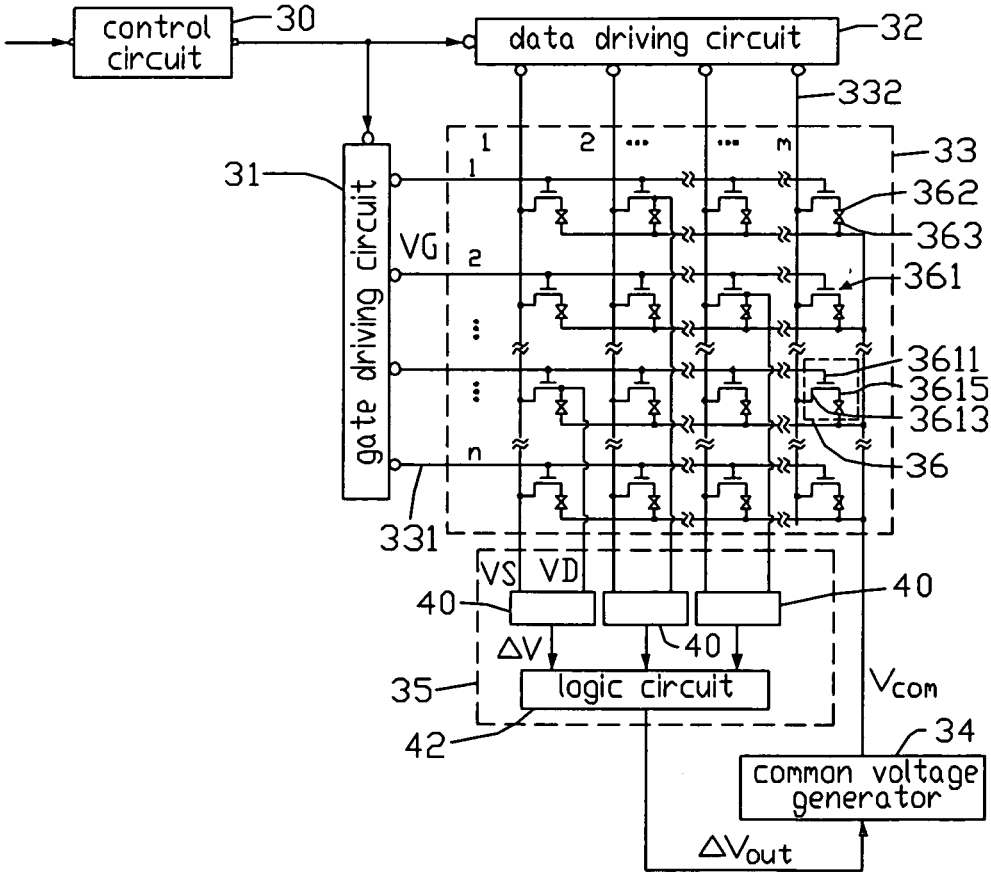
FIG. 2 is essentially an abbreviated circuit diagram of the driving circuit of the LCD of the exemplary embodiment, the driving circuit including three subtracters and a logic circuit.

Referring also to FIG. 2, the driving circuit includes a control circuit 30, a gate driving circuit 31, a data driving circuit 32, and a pixel control circuit 33. The pixel control circuit 33, the gate driving circuit 31, and the data driving circuit 32 are located on the second substrate 53. The control circuit 30 is located on a printed circuit board (not shown), and is configured to provide RGB data signals to the data driving circuit 32. The control circuit 30 is also configured to provide operation voltage signals, for example gate-on voltage signals and gate-off voltage signals, to the gate driving circuit 31. The data driving circuit 32 and the gate driving circuit 31 respectively transmit the RGB data voltage signals and the operation voltage signals to the pixel control circuit 33 according to a predetermined timing control regime.

The pixel control circuit 33 includes a number n (where n is a natural number) of gate lines 331 that are parallel to each other and that each extend along a first direction, a number m (where m is also a natural number) of data lines 332 that are parallel to each other and that each extend along a second direction orthogonal to the first direction, a plurality of TFTs 361 that function as switching elements, a plurality of pixel electrodes 362, and a plurality of common electrodes 363 correspondingly facing toward the pixel electrodes 362. The plurality of data lines 332 and the plurality of gate lines 331 cross each other, thereby defining a plurality of pixel units 36 of the pixel control circuit 33. The gate driving circuit 31 is configured to provide scanning voltage signals VG to the gate lines 331. The data driving circuit 32 is configured to provide data voltage signals VS to the pixel electrodes 362 via the data lines 332.

Each of the TFTs 361 is provided in the vicinity of a respective point of intersection of the gate lines 331 and the data lines 332. A gate electrode 3611, a source electrode 3613 and a drain electrode 3615 of each TFT 361 are connected to a corresponding gate line 331, a corresponding data line 332 and a corresponding pixel electrode 362 respectively. When the gate electrode 3611 of the TFT 361 receives a scanning voltage signal VG and is switched on, the data voltage signal VS is transmitted to the pixel electrode 362 of the corresponding pixel unit 36 and becomes a pixel voltage signal VD. Thereby, a voltage deviation value ΔV is defined. The voltage deviation value ΔV is equal to a difference between the pixel voltage signal VD and the corresponding data voltage signal VS. Because the pixel units 36 of the pixel control circuit 33 are formed in the same fabricating process, the voltage deviation values ΔV of the pixel units 36 are approximately equal to each other. This means that it is feasible to arbitrarily choose a small number of the pixel units 36 as testing units (see below). For example, pixel units 36 located in the same column and different rows of the pixel control circuit 33 can be selected, or pixel units 36 located in different columns and the same row of the pixel control circuit 33 can be selected. In this embodiment, three pixel units 36 located in three different columns and three different rows of the pixel control circuit 33 are chosen as the testing units.

The driving circuit further includes a common voltage generator 34 and a correcting circuit 35. The correcting circuit 35 includes three subtracters 40 having the same circuit structure, and a logic circuit 42. Each subtracter 40 serves as a comparator. The subtracter 40 is electrically connected to the pixel electrode 362 of a respective one of the testing units, and to an end of the data line 332 that is connected to the same testing unit. Such end of the data line 332 is the end farthest from the data driving circuit 32. Therefore the data voltage signal VS and the corresponding pixel voltage signal VD are input as voltage signals to the subtracter 40. The subtracter 40 compares the input voltage signals, obtains the corresponding voltage deviation value ΔV, and outputs the voltage deviation value ΔV to the logic circuit 42. The logic circuit 42 calculates an average of the voltage deviation values ΔV output from the three subtracters 40 respectively, reverses the polarity sign (+ or −) of the average value, and thereby obtains a common compensating voltage ΔVout. The logic circuit 42 then outputs the common compensating voltage ΔVout to the common voltage generator 34. The common voltage generator 34 is configured to regulate corresponding standard common voltages stored therein according to the common compensating voltage ΔVout, and accordingly output corrected common voltages Vcom to the common electrodes 363.

Figure 3:
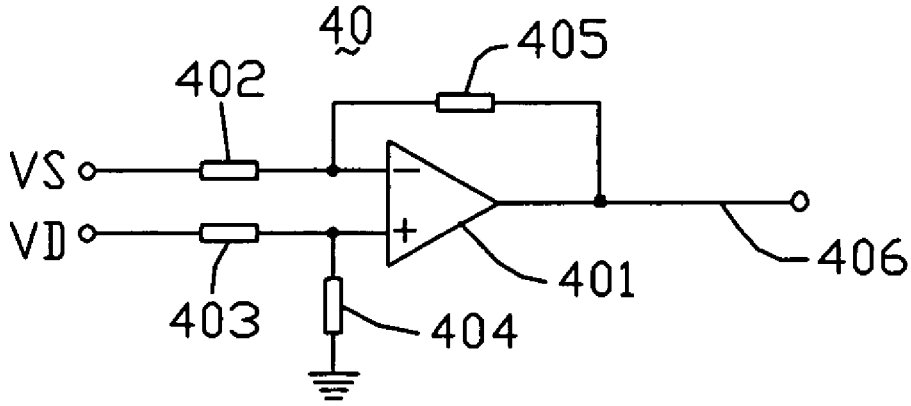
FIG. 3 is a circuit diagram of one of the subtracters of FIG. 2.

Referring also to FIG. 3, circuitry of one of the three subtracters 40 is shown. The subtracter 40 includes a first operational amplifier 401, a first resistor 402, a second resistor 403, a grounding resistor 404, a first feedback resistor 405, and an output terminal 406. The first operational amplifier 401 includes a first non-inverting input terminal (not labeled), and a first inverting input terminal (not labeled). The first non-inverting input terminal is configured to receive the pixel voltage signal VD from the pixel electrode 362 of one testing unit via the second resistor 403. The first inverting input terminal is configured to receive the data voltage signal VS from the end of the data line 332 corresponding to the testing unit via the first resistor 402. The grounding resistor 404 is connected between the first non-inverting input terminal and ground. The first feedback resistor 405 is connected between the first inverting input terminal and the output terminal 406. In an alternative embodiment, the subtracter 40 can be a non-inverting input subtracter.

Figure 4:
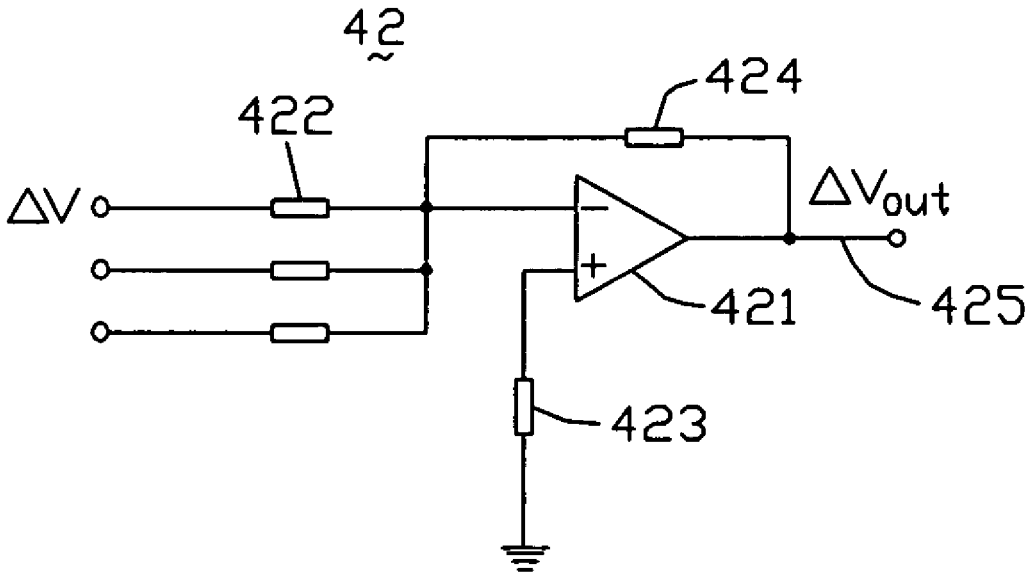
FIG. 4 is a circuit diagram of the logic circuit of FIG. 2.
Figure 5:
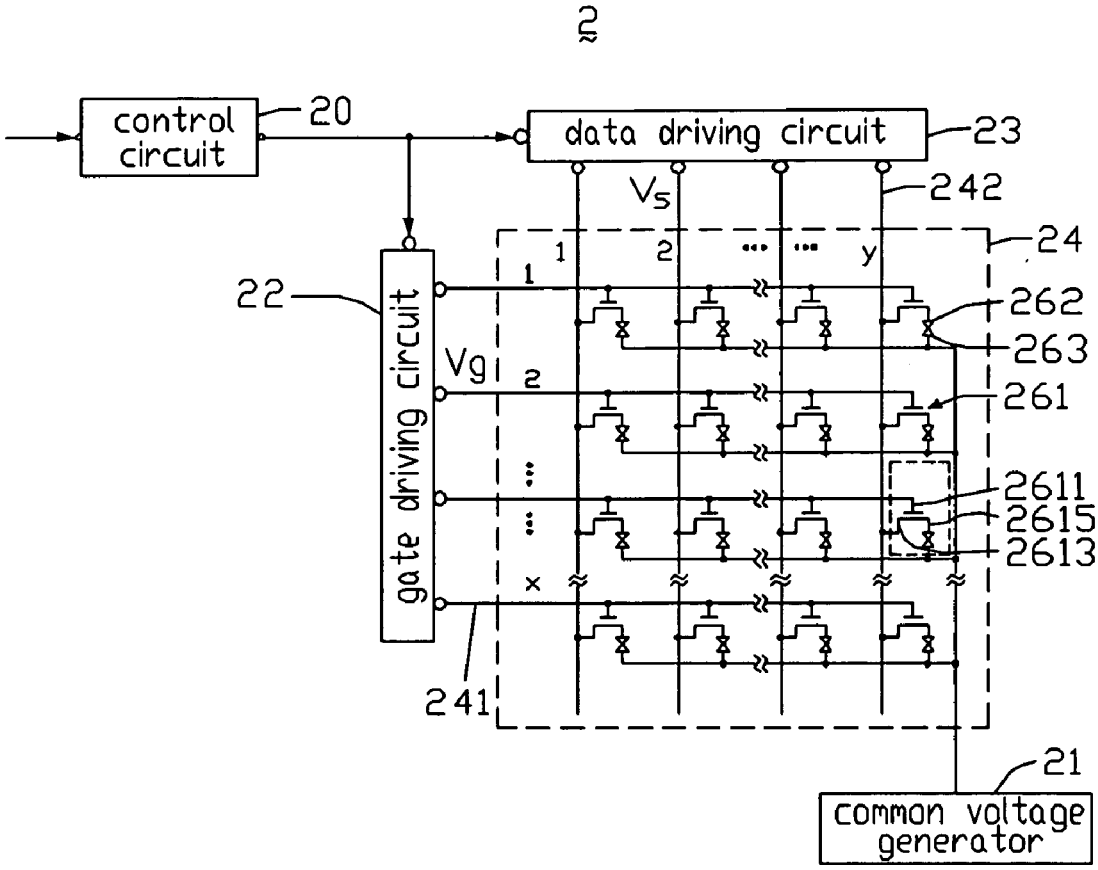
FIG. 5 (RELATED ART)
FIG. 5 is essentially an abbreviated circuit diagram of a conventional driving circuit of an LCD.

Referring also to FIG. 4, the logic circuit 42 is an opposite phase adder, and includes a second operational amplifier 421, three input resistors 422, a grounding resistor 423, a second feedback resistor 424, and an output terminal 425. The second operational amplifier 421 includes a second non-inverting input terminal (not labeled) and a second inverting input terminal (not labeled). Each input resistor 422 has the same resistance R, and is connected between the second inverting input terminal and the output terminal 406 of a respective one of the subtracters 40. The second feedback resistor 424 has a resistance value $R_f$, and is connected between the output terminal 425 and the second inverting input terminal. The grounding resistor 423 is connected between the non-inverting input terminal and ground. The output voltage of the logic circuit 42 as the common compensating voltage ΔVout satisfies the following equation: $\Delta Vout=(\Sigma\Delta V)R_f/R$, where $R_f=R/w$ and w is the number of subtracters 40. In this embodiment, w is equal to three.

When the pixel voltages signals VD are interfered with by the parasitic capacitances generated between two electrodes of the TFTs 361, the potential differences between the pixel electrodes 362 and the corresponding common electrodes 363 cannot maintain the constant value that is set for the LCD 3. At the same time, each of the subtracters 40 automatically tests the pixel voltage signals VD and the data voltage signals VS of the three pixel units 36 that are selected as the testing units, and calculates the difference values between them in order to output the voltage deviation values ΔV to the logic circuit 42. The logic circuit 42 receives the voltage deviation values ΔV, reverses the polarity sign (+ or −) of an average value of the voltage deviation values ΔV to thereby obtain the common compensating voltage ΔVout, and outputs the common compensating voltage ΔVout to the common voltage generator 34. If the common compensating voltage ΔVout is negative, the corresponding standard common voltage stored in the common voltage generator 34 is reduced by the value of |ΔVout|. If the common compensating voltage ΔVout is positive, the corresponding standard common voltage is increased by the value of ΔVout. Therefore the voltage applied to the liquid crystal molecules can maintain the preset constant value so as to avoid visible image display defects such as flickering. Furthermore, even if the ambient temperature changes or the LCD 3 is used for an extended period of time, the correcting circuit 35 still automatically regulates the voltage applied to the liquid crystal molecules. Thereby, flickering can be avoided even under demanding operating conditions.

In an alternative embodiment, the first inverting input terminals of the three subtracters 40 can be connected to source electrodes 3613 of the TFTs 361 of the three testing units respectively. In addition, when the number of pixel units 36 that are selected as testing units is a larger number, the precision of the common compensating voltage ΔVout calculated by the logic circuit 42 is higher. If the number of testing units is one, the number of subtracters 40 is correspondingly one, and the logic circuit 42 can be a phase inverter.

It is believed that the present embodiments and their advantages will be understood from the foregoing description, and it will be apparent that various changes may be made thereto without departing from the spirit or scope of the invention or sacrificing all of its material advantages, the examples hereinbefore described merely being preferred or exemplary embodiments of the invention.

What is claimed is:

1. A driving circuit comprising:

a plurality of pixel electrodes that are arranged in a matrix and are configured for receiving voltage signals via corresponding switching elements connected thereto, each switching element comprising an input electrode;

a plurality of common electrodes that respectively face toward the pixel electrodes and are configured for receiving common voltage signals;

a plurality of comparators, each selectively connected to a respective one of the pixel electrodes and a corresponding input electrode to obtain a corresponding voltage deviation value between the voltage signal of the pixel electrode and the voltage signal of the corresponding input electrode, thereby the plurality of comparators outputting the plurality of the voltage deviation values at one frame;

a logic circuit averaging the voltage deviation values output by the comparators and reversing a polarity sign of the average voltage deviation value to thereby obtain a common compensating voltage; and a common voltage generator configured for regulating and generating a common voltage signal according to the common compensating voltage, and outputting to the common voltage signal to the common electrodes.

2. The driving circuit as claimed in claim 1, wherein the logic circuit is an opposite phase adder.

3. The driving circuit as claimed in claim 2, wherein the opposite phase adder comprises an operational amplifier having a non-inverting input terminal, an inverting input terminal and an output terminal, a plurality of input resistors each connected to the inverting input terminal and a respective one of the comparators, a grounding resistor connected between the non-inverting input terminal and ground, and a feedback resistor connected between the output terminal and the inverting input terminal.

4. The driving circuit as claimed in claim 3, wherein the input resistors have the same resistance value and the number of input resistors is equal to the number of comparators.

5. The driving circuit as claimed in claim 1, wherein the logic circuit is a phase inverter.

6. The driving circuit as claimed in claim 1, wherein the common voltage generator stores standard common voltages, and if the common compensating voltage is negative the common voltage generator reduces a corresponding standard common voltage by an absolute value of the common compensating voltage, and if the common compensating voltage is positive the common voltage generator increases the corresponding standard common voltage by a value of the common compensating voltage.

7. The driving circuit as claimed in claim 1, further comprising a plurality of gate lines that are parallel to each other, and a plurality of data lines that are parallel to each other, the data lines intersecting the gate lines and being insulated from the gate lines, and a plurality of switching elements each connecting between a respectively one of the data lines and a corresponding pixel electrode, the data lines configured for providing the voltage signals to the input electrodes of the corresponding switching elements.

8. The driving circuit as claimed in claim 7, wherein a first inverting terminal of each comparator is connected to the end of the corresponding data line.

9. The driving circuit as claimed in claim 7, wherein each switching element is a thin film transistor comprising a gate electrode connected to the corresponding gate line, a source electrode serving as the input electrode, and a drain electrode connected to the corresponding pixel electrode.

10. The driving circuit as claimed in claim 9, wherein a first inverting terminal of each comparator is connected to the corresponding source electrode.

11. The driving circuit as claimed in claim 7, wherein the voltage deviation value output by each comparator is defined by a voltage drop generated by the voltage signal of the data line via the corresponding switching element.

12. The driving circuit as claimed in claim 1, wherein each comparator is a non-inverting inputting subtracter.

13. The driving circuit as claimed in claim 1, wherein the pixel electrodes connecting to the comparators are located in different lines.

14. A liquid crystal display comprising:

a liquid crystal panel comprising:

a first substrate;

a second substrate parallel to the first substrate;

a liquid crystal layer sandwiched between the first substrate and the second substrate; and a driving circuit configured for driving the liquid crystal panel, the driving circuit comprising:

a plurality of pixel electrodes that are arranged in a matrix and are configured for receiving voltage signals via corresponding switching elements connected thereto, each switching element comprising an input electrode;

a plurality of common electrodes that respectively face toward the pixel electrodes and are configured for receiving common voltage signals;

a plurality of comparators, each selectively and separately connected to one of the pixel electrodes and a corresponding input electrode to obtain a corresponding voltage deviation value between the voltage signal of the pixel electrode and the voltage signal of the corresponding input electrode, thereby the plurality of the comparators outputting a plurality of the voltage deviation values at one frame;

a logic circuit averaging the voltage deviation values output by the comparators and reversing a polarity sign of the average voltage deviation value to thereby obtain a common compensating voltage; and a common voltage generator configured for regulating and generating a common voltage signal according to the common compensating voltage, and outputting to the common voltage signal to the common electrodes.

15. The LCD device as claimed in claim 14, wherein the logic circuit is an opposite phase adder.

16. The LCD device as claimed in claim 14, further comprising a plurality of gate lines that are parallel to each other, and a plurality of data lines that are parallel to each other, the data lines intersecting the gate lines and being insulated from the gate lines, and a plurality of switching elements each connecting between a respectively one of the data lines and a corresponding pixel electrode, wherein the data lines are providing the voltage signals to the input electrodes of the corresponding switching elements, and the voltage deviation value output by each comparator is defined by a voltage drop generated by the voltage signal of the data line via the corresponding switching element.

17. The driving circuit as claimed in claim 14, wherein the pixel electrodes connecting to the comparators are located in different lines.

18. A driving method for an LCD, the LCD comprising a plurality of switching elements, a plurality of pixel electrodes configured for receiving voltage signals transmitted via respective switching elements connected thereto, and a plurality of common electrodes configured for receiving common voltage signals, each switching element comprising an input electrode, the method comprising:

selecting a plurality of the pixel electrodes as testing units;

obtaining the voltage signals transmitted to the input electrodes of the switching elements corresponding to the testing units, and obtaining the corresponding voltage signals transmitted to the pixel electrodes by the switching elements of the testing units;

calculating difference values between the voltage signals at the pixel electrodes and the voltage signals of the corresponding input electrodes to thereby obtain corresponding voltage deviation values at one frame;

averaging the voltage deviation values and reversing a polarity sign of the average voltage deviation value to thereby obtain a common compensating voltage; and regulating a common voltage input to the common electrodes according to the common compensating voltage.

19. The driving method as claimed in claim 18, wherein if the common compensating voltage is negative, a corresponding common voltage input to the common electrodes is reduced by an absolute value of the common compensating voltage, and if the common compensating voltage is positive, the corresponding common voltage input to the common electrodes is increased by a value of the common compensating voltage.

20. The driving method as claimed in claim 18, wherein the test units are located in different lines.

* * * * *